United States Patent [19]

Pearson et al.

[11] Patent Number: 4,499,460

[45] Date of Patent: Feb. 12, 1985

[54] ROS CONTROL OF GAS PANEL

[75] Inventors: Kenneth A. Pearson, Kingston; Larry R. Zucker, Saugerties, both of N.Y.

[73] Assignee: International Business Machines Corporation, Armonk, N.Y.

[21] Appl. No.: 386,493

[22] Filed: Jun. 9, 1982

[51] Int. Cl.[3] ..... G09G 3/28

[52] U.S. Cl. ..... 340/771; 340/805; 340/799

[58] Field of Search ..... 340/805, 798, 799, 800, 340/801, 771, 776

[56] References Cited

U.S. PATENT DOCUMENTS 3,851,211 11/1974 Greeson, Jr. .
3,894,506 7/1975 Mayer .
3,973,253 8/1976 Criscimagna, et al. .
4,099,096 7/1978 Holt, et al. .
4,415,892 11/1983 Marentic ..... 340/805

FOREIGN PATENT DOCUMENTS 2101178A 1/1983 United Kingdom .
2102179A 1/1983 United Kingdom .

OTHER PUBLICATIONS

IBM Technical Disclosure Bulletin, vol. 18, No. 9, 2/76, to J. B. Trushell, "Gas Panel Driving System", pp. 2929–2931.

*Primary Examiner*—Marshall M. Curtis
*Attorney, Agent, or Firm*—J. L. Abzug; J. F. Villella; J. Jancin, Jr.

[57] ABSTRACT

Operation of an AC plasma display panel requires the three control operations of write, erase, and sustain. Sustain, write and erase signals are stored in a plurality of sections in a storage device and the sections are selectively accessed according to the specific operation to be provided to the plasma panel display. Switching between the sections in the storage device is accomplished without signal discontinuity in the sustain, write, and erase signals used to drive the illuminable cells. The sustain operation is recycled during those periods when no write or erase operation is being done.

4 Claims, 3 Drawing Figures

ROS CONTROL OF GAS PANEL

CROSS REFERENCE TO RELATED APPLICATIONS

U.S. application Ser. No. 372,384 Method and Apparatus for Gas Display Panel, filed by Tony N. Criscimagna and Albert O. Piston June 21, 1973.

TECHNICAL FIELD

This invention relates to an AC plasma display system using read only storage (ROS) for control sequencing.

BACKGROUND ART

Conventional AC plasma display technology includes display panels comprising two glass plates having orthogonally positioned conductor arrays thereon encapsulated in a gas envelope, the intersections of said conductor arrays forming gas cells. The conductor arrays are overcoated with a dielectric and insulated from the gas and thus capacitively coupled to the gas in the panel. When signals exceeding the ionization potential of a pair of conductors occur during a write operation, a discharge takes place and a wall charge potential is formed on the cell walls. This potential combines with a lower level sustain signal to continuously discharge the cell at a relatively high frequency (40 KC) to maintain the discharge, while erase takes place by neutralizing the wall charge and thereby removing the wall charge potential.

The operation of an AC plasma display panel thus requires the application of sequences of three control signals, i.e., sustain, write, and erase. These signals are applied to drivers which control the energization state of the illuminable cells in the plasma panel display and are sequenced so as to provide the sustain, write, and erase operations required in the plasma panel display. The sustain operation has two separate applications. The first application as described above is to maintain the information on the plasma panel display in its then present state. The second application is to normalize a write or an erase operation by a sustain sequence. If a sustain sequence is not properly applied before and after write and erase operations, then the write or erase operation will not be successfully completed. In the preferred embodiment herein described, a plurality of three sustain sequences are required after a write or an erase operation for normalization of the cells.

A plasma panel display may be controlled by a data processing system or controller which serves two purposes in relation to the display. First, it sends data signals which are representative of the information that is to be displayed. Second, it sends the control commands, such as write or erase, which cause the information to be displayed by or erased from the plasma panel display. These control commands are received by the plasma panel through appropriate control circuitry and are operated upon so as to effect the appropriate control operations of write, sustain, and erase.

One method of accomplishing such plasma panel control is disclosed in U.S. Pat. No. 3,851,211 where individual control sequences of the sustain, write and erase signals are stored within a ROS. Logic circuitry within the panel assembly but external to the ROS, receives the control information from a data processing system or controller. The logic circuitry then selectively activates the appropriate control sequences of sustain, write, and erase within the ROS so as to effect control of the plasma panel display.

As the cost of storage continues to decline, it would be desirable to provide control of the individual operations of sustain, write and erase within a storage device located in the plasma panel assembly. By so doing, the external logic circuitry required in the prior art is simplified.

When hardwired logic is used to implement the controls, the transition from one sequence to another, for instance, from sustain to write, can be done in a manner whereby all appropriate control lines are changed without interruption. As described herein, the term "interruption" refers to the accuracy and timing of the appropriate control signals to the designated lines to effect the above operations. However, it is not obvious how this effect could be accomplished in a Read Only Storage (ROS) device. This is important in a plasma display because a momentary interruption of the sustain waveform, for instance, can be detrimental to the sustain margin.

When a ROS is used to implement the control, this interruption of the control sequence could occur during switching between sections of the ROS. This problem is solved in the instant invention by addition to the sequence which bridge the gaps between sequences so that no interruption occurs. The simplification of the logic circuitry can also bring with it an increase in reliability as well as a decrease in cost.

Accordingly, it is an object of this invention to provide improved ROS control of a gas panel display.

It is another object of this invention to provide a gas panel display wherein no signal discontinuity results when switching between control operations.

It is still another object of this invention to simplify the logic circuitry heretofore required to provide the control operations of write, erase, and sustain in a plasma panel display.

It is a further object of this invention to provide a plasma panel display wherein a ROS contains a sustain operation recycling sequence which automatically checks for new inputs of erase and write control commands.

DISCLOSURE OF INVENTION

The present invention relates to an AC plasma display panel assembly wherein a ROS assumes control of the individual control operations of write, or erase and sustain. The normal operation of the plasma display system is the sustain sequence, which is interrupted by a write or erase sequence. A ROS not only stores the individual control sequences of the write, erase and control sequences, but also selectively initiates the proper control sequences upon receipt of write or erase commands from a data processing system or controller.

Write and erase commands from a data processing system are gated to the 2 high order bits of a ROS Address Counter within the panel display assembly. These 2 gates are enabled at the conclusion of each of the sustain, write or erase operations. Conventionally, ROS devices are addressed by Address Counters. When the write and erase inputs of the Address Counter are not strobed by the data processing system or controller, thus indicating that no data is to be either written or erased, the ROS cycles through a sustain sequence. The sustain operation is repeated until a write or an erase command is received by the Address Counter. At that time, a write or erase operation corresponding to said command is initiated within the ROS. At the conclusion of a write or erase sequence, the ROS automatically cycles through three consecutive sustain sequences. As heretofore described, three sustain sequences are utilized by the plasma panel to successfully normalize selected cells after a write or erase operation. At the conclusion of the third sustain sequence, the Address Counter is once again checked for a write or an erase command. If none is found, the ROS once again recycles through a sustain sequence. The ROS continues the sustain operation recycling sequence until a write or an erase command is applied to and detected by the Address Counter.

A sustain, write, or erase signal is not the same as a sustain, write, or erase operation. Each of the three operations, i.e., sustain, write, and erase refers to functions required to enable data to be selectively displayed on the plasma panel. A sustain operation provides the required voltage and time relationships which combines with the wall charge in the illuminable cells to maintain the cells in their prescribed state. A write operation provides the required voltage and time relationships to the illuminable cells to allow new data to be selectively displayed on the panel. An erase operation provides the required voltage and time relationships to the illuminable cells to allow data to be selectively removed from the plasma panel display. The sustain, write, and erase operations are effected by drivers acting upon the illuminable cells. The information that controls the operation of the drivers comes from signals stored in the ROS. The ROS is partitioned into sections, each of the sections containing all the control lines necessary for effecting the sustain, write and erase operations.

The sustain signal is composed of two oppositely phased signals; i.e., the positive sustain signal and the negative sustain signal. Successive sustain signals are sequentially applied in opposite phases so that a positive sustain signal always follows a negative sustain signal and vice-versa. However, it will be appreciated that a full sustain signal would be applied on to one set of conductors while the orthogonal array is maintained at a reference potential.

It is a requirement of a panel display that there be no discontinuity in the plasma sustain signals sent to the drivers which drive the illuminable cells immediately before and after a write or erase control operation. To eliminate any such discontinuity, bridging sections are placed at the boundaries of the write and erase sections of the ROS. Such bridging sections are selected so that there is no signal discontinuity in the sustain signals sent to the drivers either before or after a write or an erase operation.

BEST MODE FOR CARRYING OUT THE INVENTION

Figure 1:
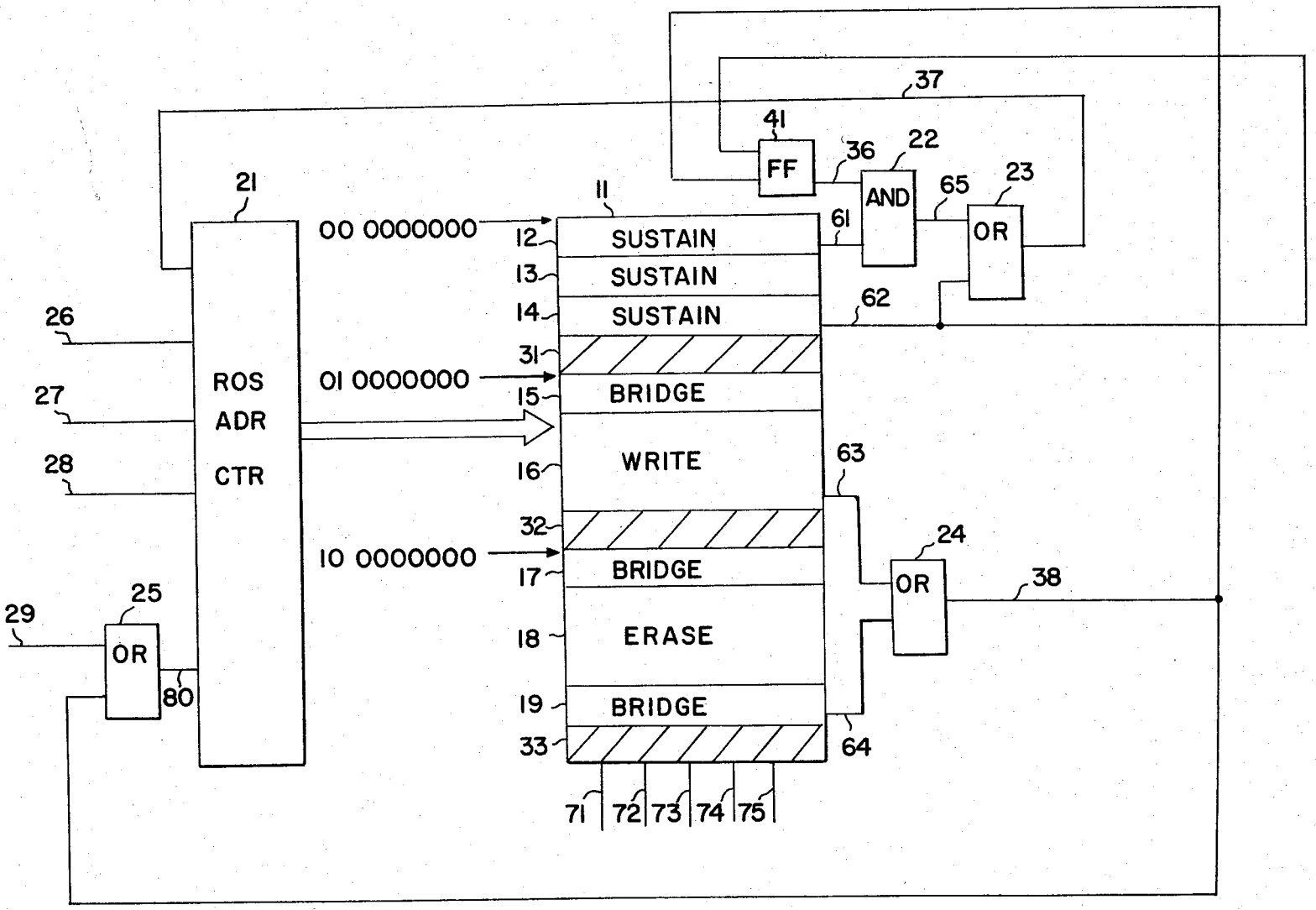
FIG. 1 is a block diagram of the preferred embodiment of the present invention.

The preferred embodiment of the present invention is shown in FIG. 1. The individual sequences of the sustain, write and erase sequences are shown in ROS 11. Also contained in ROS 11 are the bridging sequences 15, 17, and 19, each of the bridging sequences being composed of sections of the ROS containing sustain signals. The exact composition of the bridging sequences 15, 17 and 19 is dependent on the signals which they precede and follow in ROS 11. For simplification, addressing is selected such that the various sequences will fit within major binary boundaries of the ROS, leaving some unused portions such as 31, 32 and 33 for other related or unrelated functions.

Lines 71 through 75 go to cell drivers 77 (FIG. 3) external to the ROS which physically apply the control signals to the illuminable cells 78. Lines 71 and 72 are the positive sustain and negative sustain lines respectively, i.e., they carry the positive sustain and negative sustain signals to the aforementioned drivers 77. Lines 73 and 74 are the write and erase lines respectively, i.e., they carry the write and erase signals to drivers 77. Line 75 is the control line which cooperates with write and erase control lines 73, 74 to effect a write or erase operation.

ROS Address Counter 21 is used to access and activate the appropriate control sequence in ROS 11 when the address of that sequence is applied to the counter. Lines 26 and 27 are the write and erase inputs to ROS Address Counter 21 respectively. Line 28 is the step counter input to ROS Address Counter 21 which determines the rate the information in the ROS is read. In the case of a plasma panel display, this stepping rate is determined by the physics of the panel. Line 29 is the power on reset input.

Figure 2:
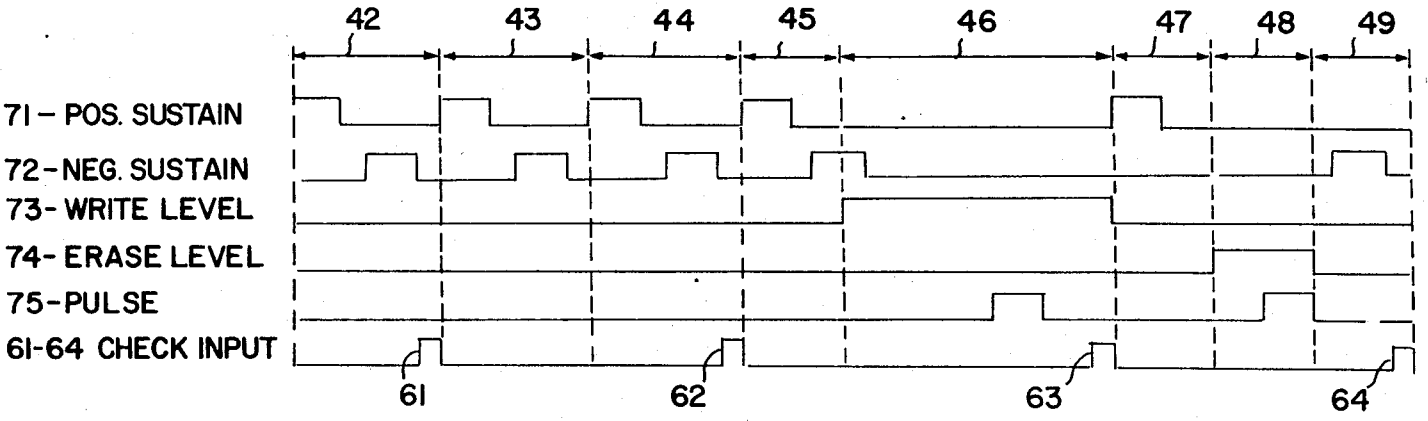
FIG. 2 is a timing diagram of the sustain, write, erase and control sequences of the present invention.

FIG. 2 displays the waveform sequences representing signals which are contained within ROS 11. The waveforms representing the various signals in interval 42 are stored within sustain 12 (see also FIG. 1) in ROS 11. The waveforms in interval 43 are stored within sustain 13 in ROS 11. The remaining waveforms in intervals 44–49 are stored within sequences 14–19 respectively in the ROS.

The operation of the invention will now be described in more detail with reference to FIGS. 1 and 2. When power is initially applied to the plasma panel display, power-on reset line 29 goes to an up level. This has the effect of turning on OR gate 25 and producing a high output at 80. The high output at 80, in turn, has the effect of resetting ROS Address Counter 21 to zero, the address position associated with sustain 12. ROS Address Counter 21 then accesses and activates sustain 12. The information contained within this section of ROS 11 is read at a rate determined by the step counter line. Lines 73, 74 and 75 corresponding to write, erase and pulse respectively, are all low during sustain 12. Lines 61, 62, 63 and 64 are actually one line named Check Input. The number designation of the line corresponds to the time in each section when it is active, as in FIG. 2, for simplifying the ensuing description. As shown in FIG. 2, the check input signal will be low throughout interval 42 until the last bit position 61 in sustain partition 12 is reached. At this point, the check input signal switches to the up level, as shown by pulse 61 in FIG. 2. This up level is transferred from the ROS to AND gate 22, the other input comprising line 36. Under normal operating conditions, line 36 is maintained at an up level until it is set to a low level by conditions described hereinafter. Therefore, when the check input line 61 goes up, AND gate 22 is turned on and line 65 goes up. With line 65 up, OR gate 23 is turned on and line 37 is high. Line 37 is fed back to the strobe input of ROS Address Counter 21 such that when line 37 is high, the 2 high order bits of ROS Address Counter 21 will take on the values of inputs 26 and 27 corresponding to the write and erase commands respectively. If neither line 26 nor line 27 is active (up), then ROS Address Counter 21 is reset and reactivates sustain partition 12. This process of accessing and activating sustain partition 12 continues until line 26 or line 27 is found active by the Check Input line 37.

If line 26 is conditioned when strobed, ROS Address Counter 21 accesses and activates bridge 15, as described above, indicated by interval 45 in FIG. 2. As can be seen in FIG. 2, the positive and negative sustain signals in interval 45 are a portion of the duration of the positive and negative sustain signals appearing in the three previous intervals. The purpose of the bridge is to ensure that there are no signal discontinuities in the positive and negative sustain signals either at the beginning or at the end of a write, an erase or a sustain sequence. Interval 46 corresponds to write partition 16 (FIG. 1). At the beginning of partition 46, the positive sustain signal is at a low level while the negative sustain signal is in the middle of an up level. Bridge 15 is made to conclude with the positive sustain signal having a low or down level and with the negative sustain signal in the middle of a high or up level, thus assuring there is no signal discontinuity in either the positive or the negative sustain signals.

If the write sequence had begun immediately following the conclusion of one of the sustain sequences stored in partitions 12–14, then a signal discontinuity would have occurred in the negative sustain signal. This is seen by referring to the negative sustain signal in intervals 42–44 in FIG. 2. In each of these intervals, the negative sustain signal concludes on a down level. However, as noted above, the write sequence begins in the middle of an up level of the negative sustain. Thus if write sequence 16 had begun immediately at the conclusion of one of the sustain sequences 12–14, a signal discontinuity would have occurred in the negative sustain signal, thereby resulting in an unsuccessful write operation.

As seen in interval 46 of FIG. 2, check input line 63 is at an up level in the last bit position of write partition 16. As a result, input 63 of OR gate 24 will be at an up level, causing line 38 to be at an up level. This occurrence has a two-fold effect. First, line 38 is fed back to OR gate 25 whose output 80 is one of the inputs to ROS Address Counter 21. This, in turn, resets ROS Address Counter 21 to address zero corresponding to sustain partition 12. The second effect is to cause input 36 of AND gate 22 to go to a down level by setting the input of flip-flop 41. When line 38 is at an up level, flip-flop 41 is set, which in this case causes output 36 of flip-flop 41 to switch from an up level to a down level. With input 36 of AND gate 22 at a down level, AND gate 22 cannot be turned on at the completion of sustain 12 when input 61 goes to an up level. As a result, line 65 is at a down level, OR gate 23 is turned off and ROS Address Counter 21 does not reaccess sustain 12. Instead, ROS Address Counter 21 continues to read and proceeds through sustain partition 13. As can be seen in interval 43 corresponding to sustain partition 14, the check input signal remains at a low level throughout. As a result, ROS Address Counter 21 continues reading through sustain partition 14.

Figure 3:
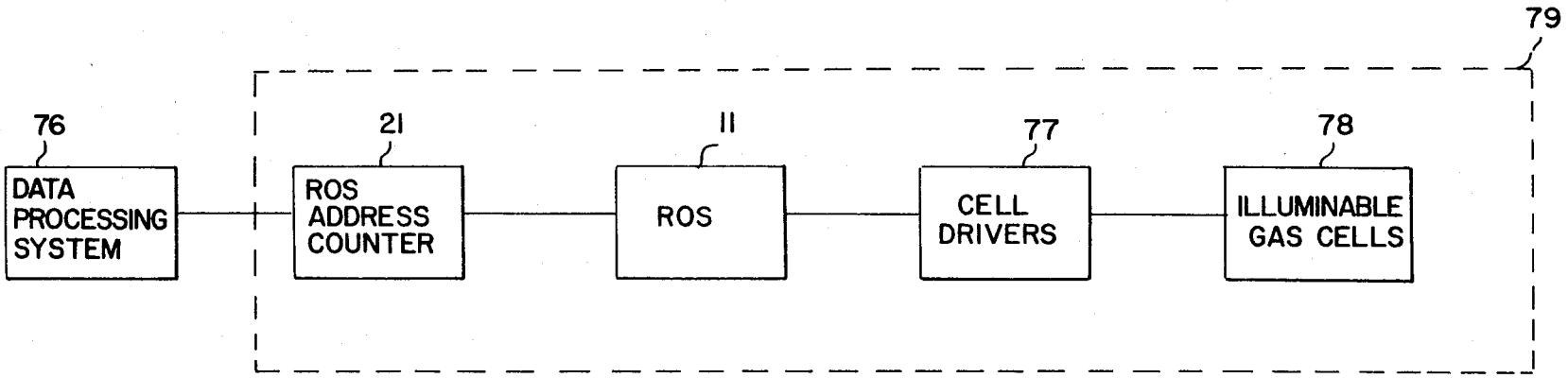
FIG. 3 is a block diagram of the overall system which comprises the environment for the present invention.

The check input line in the last bit position of sustain 14 is at an up level. This can be seen at bit position 62 in interval 44. When ROS Address Counter 21 reads this last bit position, line 62 is caused to go to an up level, resetting flip-flop 41, thereby conditioning AND gate 22 to its normal up level. Additionally, when line 62 is up, OR gate 23 turns on so that line 37 is at an up level. As explained previously, this has the effect of putting ROS Address Counter 21 into a mode wherein it scans inputs 26 and 27 to determine if a write or erase signal has been received from data processing system (FIG. 3). If either command has been received, then the appropriate control function is accessed and activated. If neither the write input 26 nor the erase input 27 have been strobed, then sustain partition 12 is once again accessed and activated.

ROS Address Counter 21 does not access erase 18 directly. When line 27, corresponding to an erase, is strobed, ROS Address Counter 21 accesses and activates bridge 17 represented by interval 47.

One of the requirements in plasma display drive systems is that the polarity of the initial write signal corresponds to the previous sustain signal and the polarity of the erase signal is 180° out of phase with the previous sustain signal. Accordingly, an erase sequence must follow an up level of the positive sustain signal and there must not be a signal discontinuity in either sustain signal at the point where the erase sequence begins. None of the sustain sequences stored in partitions 12–14 satisfy these two requirements. Each of the sustain sequences in partitions 12–14 follows an up level on the positive sustain signal on line 71 with an up level on the negative sustain signal on line 72. During the erase sequence stored in partition 18, both the negative and positive sustain signals are maintained at their respective low levels. In order for this latter condition to be fulfilled, if one of the sustain sequences in partitions 12–14 preceded the erase sequence, there would be a signal discontinuity in the negative sustain signal at the beginning of the erase sequence, which, as already stated, cannot occur if a successful erase operation is to be completed.

After bridge partition 17 has been read, ROS Address Counter 21 continues to read the information in erase and bridge partitions 18 and 19 respectively. Bridge partition 19 follows immediately after erase partition 18 for two reasons. First, as previously described, an erase sequence must be followed by a down level on the positive sustain and an up level on the negative sustain as shown in inverval 49 (FIG. 2). Second, there can be no signal discontinuity in either the positive or negative sustain sequences at the conclusion of an erase operation. As seen in FIG. 2, each of the sustain partitions 12–14 shown in intervals 42–44 begins with an up level on the positive sustain line and a down level on the negative sustain line. Since this would not satisfy the first requirement following an erase sequence, bridge partition 19 shown in interval 49 (FIG. 2) must be used.

During interval 49, the check input function in the last bit position of bridge 19 is at a high level. As a result, input 64 of OR gate 24 (FIG. 1) will be at an up level, and thus OR gate 24 will be turned on causing line 38 to be at an up level. This occurrence produces a dual effect. First, line 38 is fed back to OR gate 25 whose output 80, resets ROS Address Counter 21 to address zero corresponding to sustain partition 12.

Second, input 36 of AND gate 22 goes to a down level. Line 38 is not only fed back to OR gate 25 but also comprises the set input of flipflop 41. When line 38 is at an up level, flipflop 41 is set to provide a low level to output 36. As previously described, when this occurs, line 37 remains low causing ROS Address Counter 21 to read the data in sustain partition 13 after reading the data in partition 12. There is no recycling of the sustain sequence in partition 12 in this case. Likewise, after partition 13 has been read, the data in partition 14 is also read. At the conclusion of partition 14, line 62 which comprises the reset input of flipflop 41 is caused to go to an up level. As a result, flipflop 41 is reset so that line 36 is once again at an up level. This, in turn, puts ROS Address Counter 21 back to address zero and sustain partition 12 and the process is repeated.

While the invention has been particularly shown and described with reference to a preferred embodiment thereof, it will be understood by those skilled in the art that the foregoing and other changes in form and detail will be made therein without departing from the spirit and scope of the invention.

We claim:

1. A system for applying sustain, write and erase signal sequences to control the discharge state of a plurality of cells in a plasma display device comprising:

a storage device having a plurality of sections in which said sustain, write and erase signal sequences are stored;

means for generating erase and write command signals;

means for detecting the presence of said erase and write command signals;

means for reading said signal sequences from said storage device in response to said erase and write command signals, said erase command signal initiating the reading of said erase signal sequence, said write command signal initiating the reading of said write signal sequence, and the absence of said erase and write command signals initiating the reading of said sustain signal sequence; and means for applying said signal sequences to said plasma display device, whereby the discharge state of said plasma display device can be periodically changed in response to write and erase command signals.

2. A system as recited in claim 1, wherein said storage device comprises a Read Only Storage.

3. A system as recited in claim 1, wherein said storage device includes bridging signal sequences for bridging between said sustain, write, and erase signal sequences without signal discontinuities.

4. A system as recited in claim 1, further comprising means for generating a power-on reset command signal wherein said power-on reset command signal initiates the reading of said sustain signal sequence from said storage device.

* * * * *